US010434390B1

(12) United States Patent
Converse

(10) Patent No.: US 10,434,390 B1
(45) Date of Patent: Oct. 8, 2019

(54) METHOD FOR FABRICATING WEIGHTED BURL WOOD GOLF CLUB HEAD

(71) Applicant: Bradley Ryan Converse, Grants Pass, OR (US)

(72) Inventor: Bradley Ryan Converse, Grants Pass, OR (US)

( * ) Notice: Subject to any disclaimer, the term of this patent is extended or adjusted under 35 U.S.C. 154(b) by 42 days.

(21) Appl. No.: 15/871,859

(22) Filed: Jan. 15, 2018

Related U.S. Application Data

(60) Provisional application No. 62/446,971, filed on Jan. 17, 2017.

(51) Int. Cl.
*A63B 53/04* (2015.01)
*A63B 60/02* (2015.01)
*B27M 3/22* (2006.01)

(52) U.S. Cl.
CPC ..... *A63B 60/02* (2015.10); *A63B 53/0466* (2013.01); *A63B 53/0487* (2013.01); *B27M 3/22* (2013.01); *A63B 2053/0491* (2013.01); *A63B 2209/00* (2013.01)

(58) Field of Classification Search
CPC ..... A63B 53/0466
USPC ..... 473/324–350
See application file for complete search history.

(56) References Cited

U.S. PATENT DOCUMENTS 690,996 A * 1/1902 Ransom ..... A63B 53/04 473/343
942,353 A * 12/1909 Rigden ..... A63B 53/04 473/343
1,000,982 A * 8/1911 Biddle ..... A63B 53/0466 473/328
1,089,900 A * 3/1914 Burke ..... A63B 53/04 473/343
1,133,129 A * 3/1915 Govan ..... A63B 53/0466 473/337
1,452,695 A * 4/1923 Mattern ..... A63B 53/04 473/332
1,594,380 A 8/1924 Reitenour
(Continued)

FOREIGN PATENT DOCUMENTS

GB 2160109 A * 12/1985 ..... A63B 53/04
JP 02156967 A * 6/1990 ..... A63B 53/0466
(Continued)

*Primary Examiner* — Alvin A Hunter
(74) *Attorney, Agent, or Firm* — Jerry Haynes Law

(57) ABSTRACT

A method for fabricating weighted stabilized wood golf club heads allows for fabrication of a golf club head having enhanced control of balance, mass, center of gravity, and moment of inertia during operation of the golf club. The method includes selecting stabilized wood having a knotted and crossed grain composition and then designing a borehole pattern of boreholes based on the density and shape of the stabilized wood. The borehole pattern may be designed through a software or an algorithm to achieve efficient operation of the golf club head; and especially when swinging the golf club. The method also includes cutting a cross section of the stabilized wood, such as cutting in half. The method further comprises drilling boreholes through the cut sections of the stabilized wood, based on the borehole pattern. The cut sections of stabilized wood are clamped and adhered together. The method includes attaching a shaft and grips for operation of the golf club.

19 Claims, 13 Drawing Sheets

(56) References Cited

U.S. PATENT DOCUMENTS 1,538,415 A * 5/1925 Tootle ..... A63B 53/04 473/344
1,567,323 A * 12/1925 Jordan ..... A63B 53/10 473/343
1,598,050 A * 8/1926 Butchart ..... A63B 53/04 473/344
1,621,750 A * 3/1927 Questel ..... A63B 53/04 473/344
1,659,273 A * 2/1928 Link ..... A63B 53/04 473/343
1,659,274 A * 2/1928 Link ..... A63B 53/04 473/343
1,666,174 A * 4/1928 Holland ..... A63B 53/0487 473/251
1,680,881 A * 8/1928 Heeter ..... A63B 53/04 473/343
1,768,378 A * 6/1930 Smith ..... A63B 53/04 473/343
1,774,590 A * 9/1930 Buhrke ..... A63B 53/04 473/328
1,854,548 A * 4/1932 Hunt ..... A63B 53/04 473/329
1,901,562 A * 3/1933 Main ..... A63B 53/04 473/330
1,910,055 A * 5/1933 Reach ..... A63B 53/04 473/344
2,014,829 A * 9/1935 Young ..... A63B 53/04 473/344
2,067,556 A * 1/1937 Wettlaufer ..... A63B 53/02 473/308
2,163,091 A * 6/1939 Held ..... A63B 53/08 473/338
2,301,369 A * 11/1942 Carvill ..... A63B 53/04 473/344
2,654,608 A * 10/1953 Liebers ..... A63B 53/0466 473/343
2,750,194 A * 6/1956 Clark ..... A63B 53/08 473/337
2,936,248 A * 5/1960 Marciniak ..... A63B 53/04 427/297
3,390,881 A * 7/1968 Senne ..... A63B 53/04 473/342
3,455,558 A * 7/1969 Onions ..... A63B 53/10 473/290
3,466,047 A * 9/1969 Rodia ..... A63B 53/0466 473/338
3,556,532 A * 1/1971 Ballmer ..... A63B 53/04 473/332
3,556,533 A * 1/1971 Hollis ..... A63B 53/04 473/338
3,582,081 A * 6/1971 Caplan ..... A63B 53/04 473/338
3,591,183 A * 7/1971 Ford ..... A63B 53/04 473/314
3,652,094 A * 3/1972 Glover ..... A63B 53/08 473/337
3,692,306 A * 9/1972 Glover ..... A63B 53/02 473/306
3,825,991 A 7/1974 Cornell
D243,778 S * 3/1977 Raymont ..... 473/344
4,043,563 A * 8/1977 Churchward ..... A63B 53/08 473/338
4,063,737 A * 12/1977 Tom ..... A63B 53/02 473/311
4,085,934 A * 4/1978 Churchward ..... A63B 53/04 473/338
4,123,060 A * 10/1978 Sterling ..... A63B 53/04 473/343
4,199,632 A * 4/1980 Travis ..... A63B 53/02 428/54
4,206,924 A * 6/1980 Koralik ..... A63B 53/04 473/349
4,241,115 A * 12/1980 Temin ..... A63B 59/00 428/336
4,322,083 A * 3/1982 Imai ..... A63B 53/04 473/344
4,432,550 A * 2/1984 Byars ..... A63B 53/04 473/343
4,496,421 A * 1/1985 Byars ..... A63B 53/04 156/304.1
4,555,115 A * 11/1985 You ..... A63B 53/04 473/343
4,568,088 A * 2/1986 Kurahashi ..... A63B 53/04 473/343
4,695,054 A * 9/1987 Tunstall ..... A63B 53/04 473/338
4,803,023 A 2/1989 Enomoto et al.
4,804,188 A * 2/1989 McKee ..... A63B 53/04 473/342
4,869,507 A * 9/1989 Sahm ..... A63B 53/04 473/337
4,890,840 A * 1/1990 Kobayashi ..... A63B 53/04 473/344
4,934,703 A * 6/1990 Delaney ..... A63B 53/04 473/342
5,143,571 A * 9/1992 Lacoste ..... A63B 53/04 156/245
5,273,283 A * 12/1993 Bowland ..... A63B 53/04 473/338
5,338,024 A * 8/1994 Baum ..... A63B 53/04 264/510
5,362,055 A 11/1994 Rennie
5,489,097 A * 2/1996 Simmons ..... A63B 53/0487 473/326
5,511,787 A * 4/1996 Baum ..... A63B 53/04 473/329
5,947,840 A * 9/1999 Ryan ..... A63B 53/04 473/335
6,012,989 A * 1/2000 Saksun, Sr. ..... A63B 53/02 473/341
6,089,994 A * 7/2000 Sun ..... A63B 53/04 473/338
8,202,175 B2 * 6/2012 Ban ..... A63B 53/0466 473/338
2002/0128089 A1 9/2002 Sillers et al.
2014/0221125 A1 4/2014 Day

FOREIGN PATENT DOCUMENTS

JP 02167181 A * 6/1990 ..... A63B 53/0466
JP 06105937 A * 4/1994 ..... A63B 53/04
JP 2006223324 A * 8/2006

* cited by examiner

METHOD FOR FABRICATING WEIGHTED BURL WOOD GOLF CLUB HEAD

CROSS-REFERENCES TO RELATED APPLICATIONS

This application claims priority from U.S. Provisional Application Ser. No. 62/446,971, entitled "Method for Fabricating Weighted Burl Wood Golf Club Head", filed on Jan. 17, 2017, which application is hereby incorporated herein by reference in its entirety.

FIELD OF THE INVENTION

The present invention relates generally to a method for fabricating golf club head. More so, the present invention relates to a method for fabricating a weighted stabilized wood golf club head.

BACKGROUND OF THE INVENTION

Golf clubs are formed through a variety of methods. Commonly, a golf club head is forged or cast, and then machined to the requisite dimensions and quality. The weight, balance, and performance characteristics of a golf club can be manipulated by selectively adding weight to the club heads. Typically, weight is added by applying thin strips of lead tape with an adhesive backing to the club head. In this manner the swing weight is increased and the center of gravity is altered to change the dynamics of the head during the swing and, therefore, the ball flight characteristics after contact. The location of the lead tape, however, is generally limited to the back, crown, and sole of the club heads, where it would best stay affixed and not alter the appearance of the club.

In other instances, a change in weight of a golf club head has been usually accomplished by drilling a hole in the club head, and either leaving it void if the weight is to be reduced, or filling it with heavy material, such as lead, if the weight is to be increased. It will be appreciated that this manner of adjusting the swing weight is not very satisfactory in that it does not provide a very finite or sensitive adjustment. In addition, the adjustment is irreversible in that once the hole is drilled, the club may never be returned to its original characteristics.

Additionally, a common practice is to inject a hot melt glue or similar material into a hole in the club head during final assembly to arrive at a prescribed swing weight. The location that the glue puddles and adheres to the inner walls is determined by the orientation of the head while the glue is still hot and fluid. This technique is also used to customize the center of gravity of the club head for specific golfers' needs. The location of the glue, however, is generally limited to one broad area due to the closed process, and once the glue is set, the glue is not adjustable.

Numerous innovations have been provided in prior art that are adapted to apparatus and method for fabricating weighted golf club heads. Even though these innovations may be suitable for the specific purposes to which they address, however, they would not be as suitable for the purposes of the present invention.

For example, U.S. Pat. No. 1,504,380 to Reitenour discloses a double faced symmetrical golf club that allows placement of weights inside the club head by boring a plurality of cylindrical interconnected cavities and pouring molten metal into the cavities until the cavities and connecting holes are filled, and allowing the metal to harden inside the club head.

U.S. Pat. No. 3,466,047 to Connelly et al. teaches a golf club head having a weight plug with a threaded, recessed bottom surface having threaded recesses to receive threaded adjusting weights to adjust the balance the weight of the club head.

U.S. Pat. No. 3,825,991 to Cornell discloses a golf club iron head comprising two separate parts that are manufactured by a forging process and by a screw machine process, and to unite the parts to form a complete head.

U.S. Pat. No. 4,803,023 to Enomoto et al. describes a wood-type golf club head having an FRP shell having a cavity at the center of gravity and a foam resin core, wherein the resin is infused into the FRP shell cavity in the form of fine beads or solution. The cavity is closed by a support plate. A plug as a weight balance adjusting piece is screwed into the support plate in direct contact with the foam resin core for secure holding of the weight balance adjusting piece during use of the club.

U.S. Pat. No. 5,362,055 to Rennie describes an oversized metal wood golf club head having a nonmetallic insert secured to a cavity formed in ball striking face of the club. The insert is secured in the cavity by adhesion which is enhanced by channels formed in the insert cavity and hollow columns formed in the insert to achieve a larger sweet spot on the ball striking face of the club.

U.S. Pat. Application No. 20020128089 to Sillers et al. describes a metal-wood golf club having a removable sole plate that exposes one or more recessed cavities within the sole, into which lead tape or another suitable weighting material can be inserted to achieve precise weight distribution and modifying the center of gravity within the head.

U.S. Pat. Application No. 20140221125 to Day describes methods and systems for selecting and fabricating individualized golf clubs or golf club components. The golf club components include custom golf club heads fabricated using laser cutting to produce a plurality of flat structures from which a portion of a club head is constructed.

It is apparent now that numerous innovations for fabricating weighted golf club heads have been developed in the prior art that are adequate for various purposes. Furthermore, even though these innovations may be suitable for the specific purposes to which they address, accordingly, they would not be suitable for the purposes of the present invention as heretofore described. Thus a method and apparatus for fabricating weighted stabilized wood golf club heads for facilitating enhanced control of balance, mass, center of gravity, and moment of inertia during operation of the golf club head is needed.

SUMMARY OF THE INVENTION

The present invention relates to a method for fabricating a weighted stabilized wood golf club head having enhanced control of balance, mass, center of gravity, and moment of inertia during operation of the golf club head; whereby the method includes selecting a portion of stabilized wood having a knotted and ingrain composition and then designing a borehole pattern of boreholes based on the density and shape of the stabilized wood for efficient operation of the golf club head; whereby the method also includes cutting the stabilized wood, drilling boreholes through the cut sections based on the borehole pattern, and then adhering the cut sections together again; and whereby the method also includes attaching a shaft and grips for operation of the golf club head.

According to an aspect of the present invention, a method for fabricating a weighted stabilized wood golf club head comprises the steps of providing portion of stabilized wood, the stabilized wood defined by an external surface and an internal medium having a substantially knotted composition and crossed grains; calculating the density of the portion of stabilized wood through analysis of the measurements and weight of the portion of stabilized wood; designing a borehole pattern of internal boreholes for the internal medium of the stabilized wood, the borehole pattern based partially on the calculated density, the borehole pattern configured to enable enhanced control of balance, mass, center of gravity, and moment of inertia during operation of the golf club head; cutting a cross-section of the stabilized wood, whereby two flat surfaces form; drilling a plurality of boreholes through at least one of the two flat surfaces that correspond to the borehole pattern; filling the plurality of boreholes with a plurality of discrete weight members; adhering each weight member into the respective borehole; pressing the two flat surfaces of the stabilized wood together; adhering the external surface and the edges of the two flat surfaces of the portion of stabilized wood, such that the cut cross-section is substantially not visible; applying a composition and an indicia on the external surface; attaching a shaft to the portion of stabilized wood, the shaft comprising a distal end and a proximal end that engages the stabilized wood; and attaching a grip to the distal end of the shaft.

In view of the foregoing, it is therefore an objective of the present invention is to provide a golf club head fabricated from stabilized wood and including multiple internally placed discrete weight members to achieve the desired weight of the club head.

Another objective is to provide an improved golf club head construction wherein the weight and balance of the club head can be quickly, easily and effectively adjusted in a simple arrangement without substantially modifying the club head.

Yet another objective is to position an adjustable weight within the head of a golf club to vary its balance, Yet another objective is to provide a means for adjusting the weight and/or balance of a golf club in a manner which does not change the outer appearance of the club and which will not be apparent from a visual examination.

Yet another objective is to provide a software algorithm that designs a borehole pattern configuration for strategically placing discrete weighted members into an internal medium of a portion of stabilized wood, such that the borehole pattern enhances the location of the center of gravity, the swing weight, the total weight, and the balance of a golf club.

Yet another objective is to enable placement of variously sized and weighted metal weight members into the borehole pattern of bore holes formed in the stabilized wood.

Yet another objective is to minimize unsightly cutting planes formed from the cutting of the cross section of stabilized wood.

Yet another objective is to integrate a shaft and grip onto the stabilized wood, so as to form a complete golf club.

Yet another objective is allows golfers to have a highly customized putter that appears natural, while feeling very pure and engineered.

Yet another objective is to provide an inexpensive to operate method for fabricating a stabilized wood golf club head with internally integrated discrete weight members for enhancing operation of the golf club.

Other objectives and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1A:
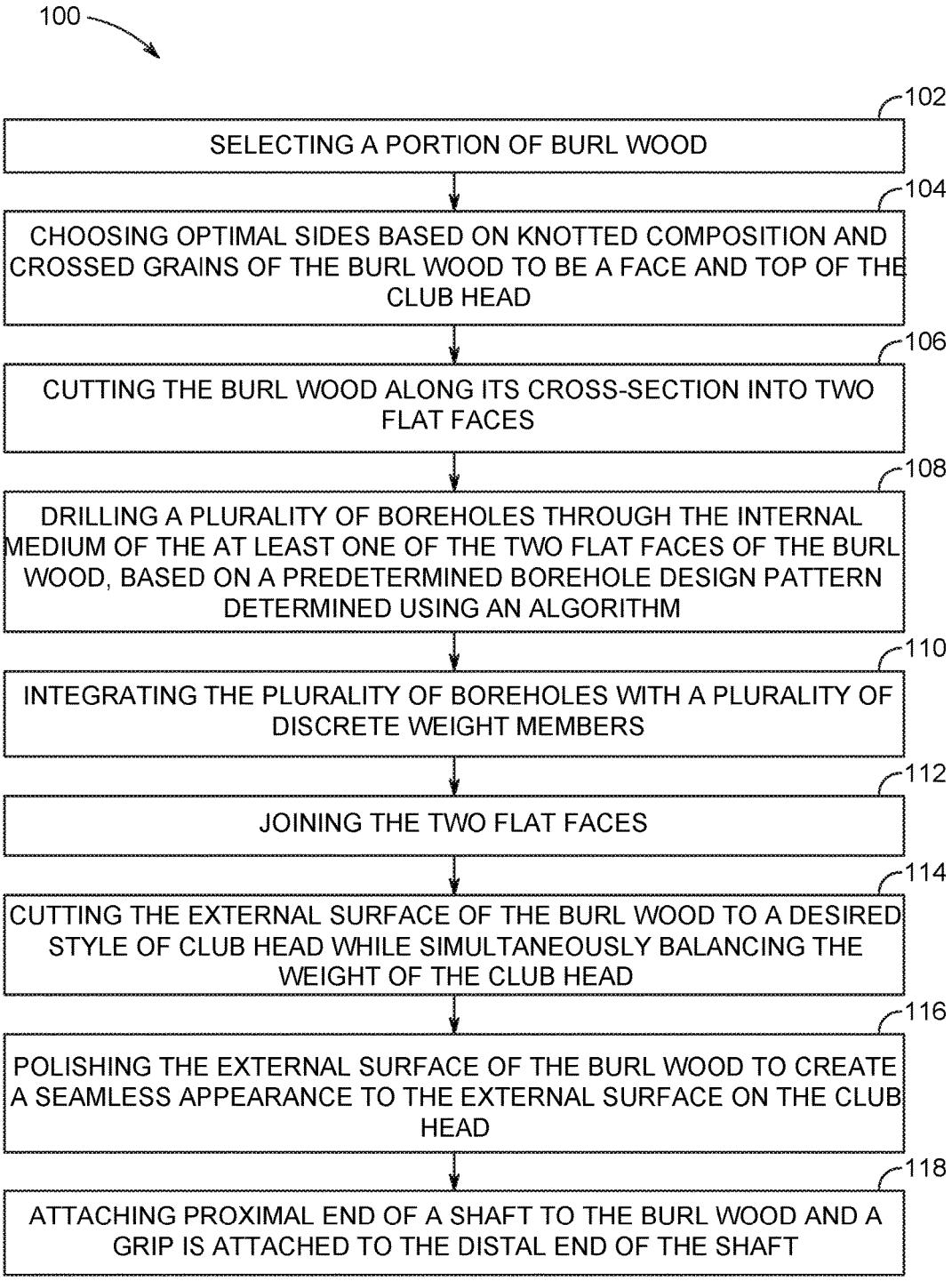
FIG. 1A illustrates a flowchart diagram of an exemplary method for fabricating a weighted stabilized wood golf club head, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIGS. 1A-12. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A method 100 for fabricating a weighted stabilized wood golf club head is referenced in FIG. 1. The method 100 for fabricating a weighted stabilized wood golf club head, hereafter "method 100", allows for fabrication of a wood golf club head 210 from a portion/block of stabilized wood 200, preferably burl wood, such that the club head 210 exhibits enhanced control of balance, mass, center of gravity, and moment of inertia during operation of a golf club 230. In essence, the method 100 allows for the strategic integration of discrete weighted members 212 inside the internal medium of the burl wood 200, so as to customize the location of the center of gravity, the swing weight, the total weight, and the balance of a golf club 230; and further allows for the integration of discrete weight members 212 to be substantially invisible from the external surface 202 of the golf club head 210.

In some embodiments, the method 100 may include selecting a portion of burl wood 200 based on appropriate dimensions for a golf club head. The burl wood 200 is defined by a knotted and cross-grain composition, which creates a hard, dense wood. The method 100 also requires designing a borehole pattern 214 of boreholes 218 that can be drilled into the internal medium of the burl wood 200. The borehole pattern 214 is based on the density and shape of the burl wood 200. The borehole pattern 214 may be designed through software or an algorithm 150 to achieve efficient operation of the golf club head 210; and especially when swinging the golf club 230.

Figure 12:
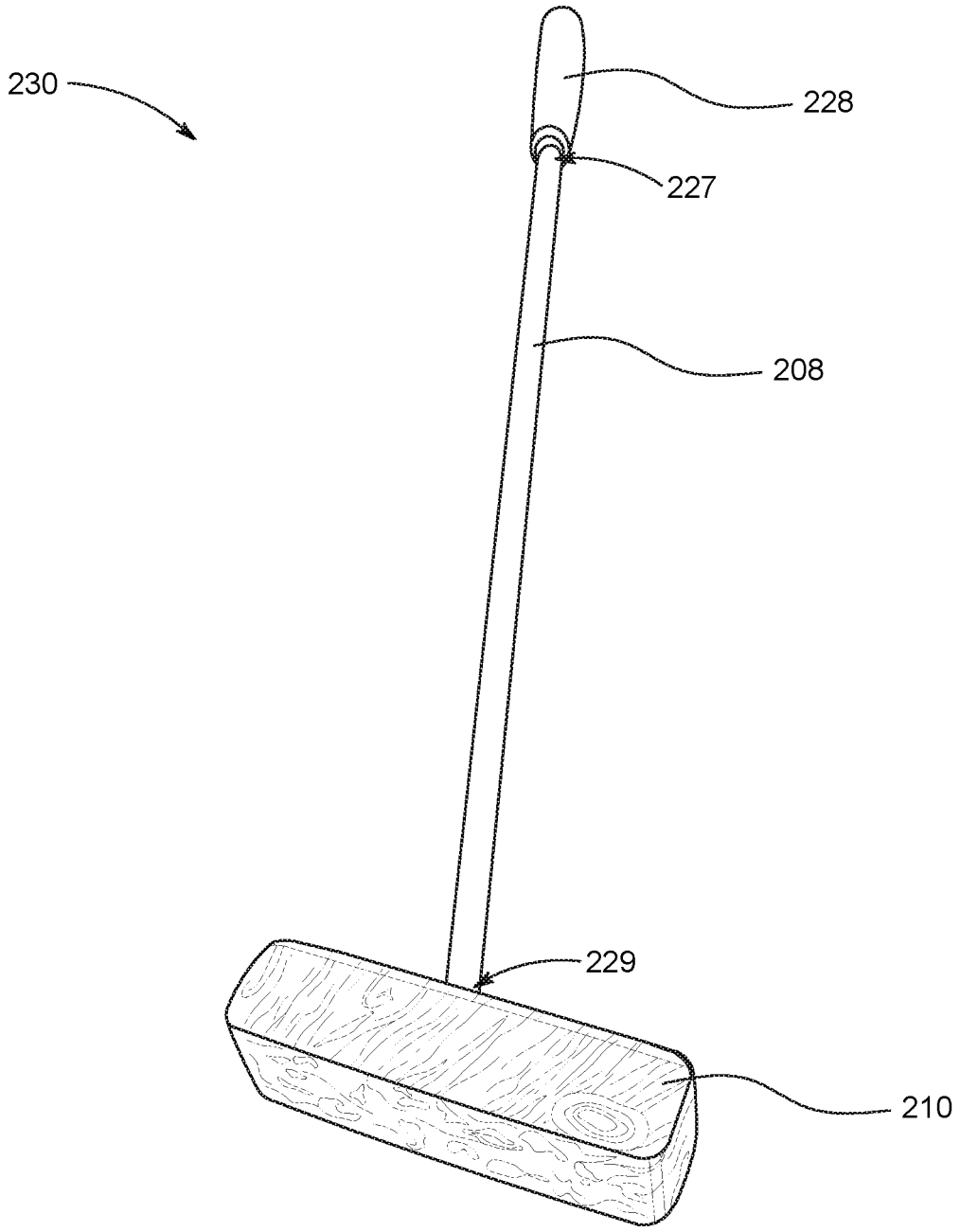
FIG. 12 illustrates a perspective view of a golf club comprising a weighted stabilized wood golf club head attached with a shaft, in accordance with an embodiment of the present invention.

In some embodiments, the method 100 may also include cutting a cross section of the burl wood 200, such as cutting the burl wood 200 into a first flat face 204*a* and a second flat face 204*b*. The method 100 further comprises drilling a plurality of boreholes 218 through at least the first flat face 204*a* or the second flat face 204*b* or both flat faces 204*a*, 204*b* of the burl wood 200, based on the borehole pattern 214. The cut sections 204*a*, 204*b* of burl wood 200 are then clamped and adhered together. The method 100 may also include attaching a shaft 208 and grips 228 for operation of the golf club 230 as illustrated in FIG. 12. The golf club head 210 may then be tested for a desired balance and functionality. Adjustments may be made to achieve a more precise control of balance, mass, center of gravity, and moment of inertia by cutting small, angled sections from the burl wood 200.

One aspect of a method 100 for fabricating a weighted burl wood 200 golf club head 210, comprises: providing portion of burl wood 200, the burl wood 200 defined by an external surface 202 and an internal medium having a substantially knotted composition and crossed grains; calculating the density of the portion of burl wood 200 through analysis of the measurements and weight of the portion of burl wood 200; designing a borehole pattern 214 of internal boreholes 218 in the internal medium of the burl wood 200, the borehole pattern 214 based partially on the calculated density, the borehole pattern 214 configured to enable enhanced control of balance, mass, center of gravity, and moment of inertia during operation of the golf club head 210; cutting a cross-section of the burl wood 200 into two substantially flat faces 204*a*, 204*b*; drilling a plurality of boreholes through at least one of the two flat surfaces that correspond to the borehole pattern 214; filling the plurality of boreholes 218 with a plurality of discrete weight members 212; adhering each weight member 212 into the respective borehole 218; pressing the two flat surfaces of the burl wood 200 together; adhering the external surface 202 and the edges of the two faces 204*a*, 204*b* of the portion of burl wood 200, such that the cut cross-section is substantially seamless; applying a composition and an indicia 206 on the external surface 202; attaching a shaft 208 to the portion of burl wood 200, the shaft 208 comprising a distal end and a proximal end that engages the burl wood 200; and attaching a grip 228 to the distal end of the shaft 208.

In another aspect of the present invention, a method for fabricating weighted burl wood golf club head 210, the method comprising: step 102 of selecting a portion of burl wood 200 based on its desired color, variation, hardness, shape, and density, wherein the burl wood 200 is defined by an external surface 202, inner surface 203 and an internal medium (not shown) having a substantially knotted composition and crossed grains; choosing optimal sides based on the knotted composition and the crossed grains to be a face and top of the club head 210; cutting the burl wood 200 along its cross-section into two flat faces 204*a*, 204*b*; drilling a plurality of boreholes 218 through the internal medium of the at least one of the two flat faces 204*a*, 204*b* of the burl wood 200, wherein the plurality of boreholes 218 are drilled based on a predetermined borehole design pattern 214 for each style of club head 210, whereby the borehole design pattern 214 is determined using an algorithm 150; integrating the plurality of boreholes 218 with a plurality of discrete weight members 212, so as to customize the location of a center of gravity, the swing weight, total weight, moment of inertia and enhance balance of a golf club 230; joining the two flat faces 204*a*, 204*b* in such a manner as to give an appearance that the burl wood 200 is uncut; cutting the external surface 202 of the burl wood 200 to a desired style of club head 210 while simultaneously balancing the weight of the club head 210; polishing the external surface 202 of the burl wood 200 to create a seamless appearance to the external surface 202 on the club head 210; and attaching a shaft 208 to the portion of burl wood 200, wherein the shaft 208 comprises a distal end 227 and a proximal end 229, the proximal end 229 of the shaft 208 engages the burl wood 200 and a grip 228 is attached to the distal end 227 of the shaft 208 as illustrated in FIG. 12.

In another aspect, the method 100 wherein the portion of the burl wood 200 is cut square on all sides before cutting the burl wood 200 along its cross-section into the two flat faces 204*a*, 204*b*.

In another aspect, the two flat faces 204*a*, 204*b* are joined by applying adhesive to inside surfaces 203 of the two flat faces 204*a*, 204*b* and tightly holding together the two flat faces 204*a*, 204*b* of the burl wood 200 by one or more clamps 226, thereby curing a joint between the two flat faces 204*a*, 204*b*.

In another aspect, the method 100 further comprises a step 108 of drilling a shaft borehole 216 in the portion of the burl wood 200.

In another aspect, the drilled shaft bore 216 is defined by an angle of at least 10 degrees with respect to the vertical axis of the club head 210.

In another aspect, polishing comprises sanding the external surface 202 of the burl wood 200 in such a manner as to give an appearance that the burl wood 200 is uncut.

In another aspect, the golf club head 210 is a wooden putter.

In another aspect, the plurality of discrete weight members 212 comprise a metal selected from the group consisting of lead, tungsten and gold.

In another aspect, each weight members 212 have different weights.

In another aspect, the method 100 further comprises a step of selectively cutting sections from the burl wood 200, so as to balance weight of the club head 210 and achieve desired angles on the external surfaces 202 of the club head 210.

In another aspect, the algorithm 150 comprises: step 152 of calculating a density of the burl wood; step 154 of multiplying the density of the wood block by a known volume of a desired shape of the club head to determine the weight of the wood in the club head; step 156 of subtracting the weight of the wood in the club head from the desired weight of the club head determines a necessary weight of the weight members; and step 158 of distributing the total weight of the weight members among the number of weight members, wherein the number of weight members is equal to the number of boreholes in the design pattern of the club head.

In another aspect of the present invention, a method 100 for fabricating weighted burl wood golf club head comprising: step 102 of selecting a portion of burl wood based on its desired color, variation, hardness, shape, and density, wherein the burl wood is defined by an external surface and an internal medium having a substantially knotted composition and crossed grains; step 104 of choosing optimal sides based on individual characteristics to be a face and top of the club head, wherein the portion of the burl wood is cut square on all sides; step 106 of cutting the burl wood along its cross-section into two flat faces; step 108 of drilling a plurality of boreholes through the internal medium of the at least one of the two flat faces of the burl wood, wherein the plurality of boreholes are drilled based on a predetermined borehole design pattern, whereby the borehole design pattern, number of weight members and the weight of each of the weight members is determined using an algorithm, thereby allowing integration of the weight members into the boreholes, so as to customize the location of a center of gravity, swing weight, total weight, moment of inertia and balance of a golf club, wherein the algorithm comprises: calculating a density of the burl wood, multiplying the density of the wood block by a known volume of a desired shape of the club head to determine the weight of the wood in the club head, subtracting the weight of the wood in the club head from the desired weight of the club head determines the necessary weight of the weight members, and distributing the total weight of the weight members among the number of weight members, wherein the number of weight members is equal to the number of boreholes in the design pattern of the club head; step 110 of integrating each of the weight members into the respective boreholes, wherein the heaviest weight member is integrated into the front of the golf club head and the lightest weight member is integrated into the back of the golf club head; step 112 of joining the two flat faces by applying adhesive to inside surfaces of the two flat faces and tightly holding together the two flat faces of the burl wood, thereby creating a joint, so as to cure the joint and provide an appearance that the burl wood is uncut; step 114 of cutting the external surface of the burl wood to the desired style of club head and step 116 of polishing it to create a seamless appearance of the external surface on the club head; step 118 of drilling a shaft borehole in the portion of burl wood; and attaching a shaft to the shaft borehole, wherein the shaft comprises a distal end and a proximal end, the proximal end of the shaft engages the burl wood and a grip is attached to the distal end of the shaft.

In another aspect, the step 110 of integrating the weight members into the boreholes comprises integrating the heaviest weight member into the front of the golf club head and integrating the lightest weight member into in the back of the golf club head.

In another aspect, step 112 of joining the two flat faces comprises applying adhesive to inside surfaces of the two flat faces and tightly holding together the two flat faces of the burl wood, thereby creating a joint, so as to cure the joint and provide an appearance that the burl wood is uncut.

In another aspect of the present invention, a weighted burl wood golf club head 210, comprising: two flat faces of the club head 204*a*, 204*b*, wherein the flat faces 204*a*, 204*b* are defined by external surfaces 202, inner surface 203 and an internal medium (not shown) having a substantially knotted composition and crossed grains; a plurality of boreholes 218 at the inner surface 203 through the internal medium of at least one of the two faces 204*a*, 204*b* of the burl wood 200 following a predetermined borehole design pattern 214 for each style of the club head 210; a plurality of discrete weight members 212 inserted into the respective plurality of boreholes 218, wherein the heaviest weight member being in the front and the lightest weight member being arranged in the back of the borehole design pattern 214, whereby the borehole design pattern 214, number of weight members 212 and the weight of each of the weight members 212 is determined using an algorithm 150, thereby allowing integration of the weight members 212 into the boreholes 218, so as to customize the location of a center of gravity, swing weight, the weight, moment of inertia and balance of a golf club 230; a shaft 208 comprising a distal end 227 and a proximal end 229, wherein the proximal end 229 of the shaft 208 is attached to a shaft borehole 216 on the external surface 202 of the burl wood club head 210 and a grip 228 is attached to the distal end 227 of the shaft 208.

The present method 100 attempts to overcome the limitations of the prior arts through systematic fabrication of a weighted burl wood golf club head 210 that exhibits enhanced control of balance, mass, center of gravity, and moment of inertia during operation of the golf club 230. In this manner, golfers can experience a highly customized putter that appears natural, while feeling very pure and engineered.

FIG. 1A illustrates a flowchart diagram of an exemplary method 100 for fabricating a weighted burl wood golf club head. The method 100 may include an initial Step 102 of selecting a portion of burl wood based on its desired color, variation, hardness, shape, and density, wherein the burl wood is defined by external surface, inner surface, and an internal medium having a substantially knotted composition and crossed grains. Those skilled in the art will recognize that burl wood 200 is stronger and harder than other woods. Burl wood 200 also enables fabrication of customized shapes not possible with any other type of wood.

Figure 2:
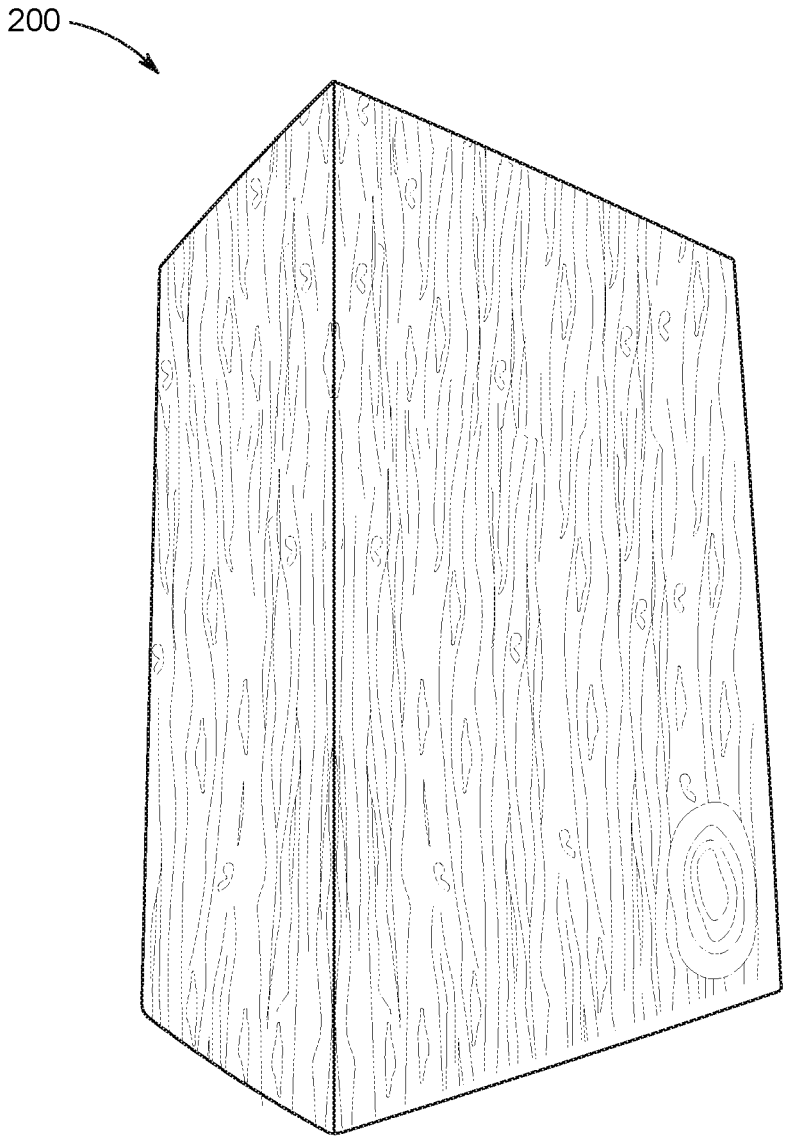
FIG. 2 illustrates a perspective view of a portion of a stabilized wood, in accordance with an embodiment of the present invention.

FIG. 2 illustrates a perspective view of an exemplary portion of burl wood 200. In one embodiment, a piece of stabilized burl wood 200 is selected for its color, variation, hardness, shape, and density. The optimal sides are chosen based on individual characteristics to be the face and top. The block of burl wood 200 is then cut square on all sides, unless it is a live edge putter, which will leave any or all of the three sides which are not the face appearing natural and bumpy.

The method 100 may further comprise a Step 104 of choosing optimal sides of the burl wood 200 based on the knotted composition and the crossed grains to be a face and top of the club head as shown in FIG. 2.

Figure 3:
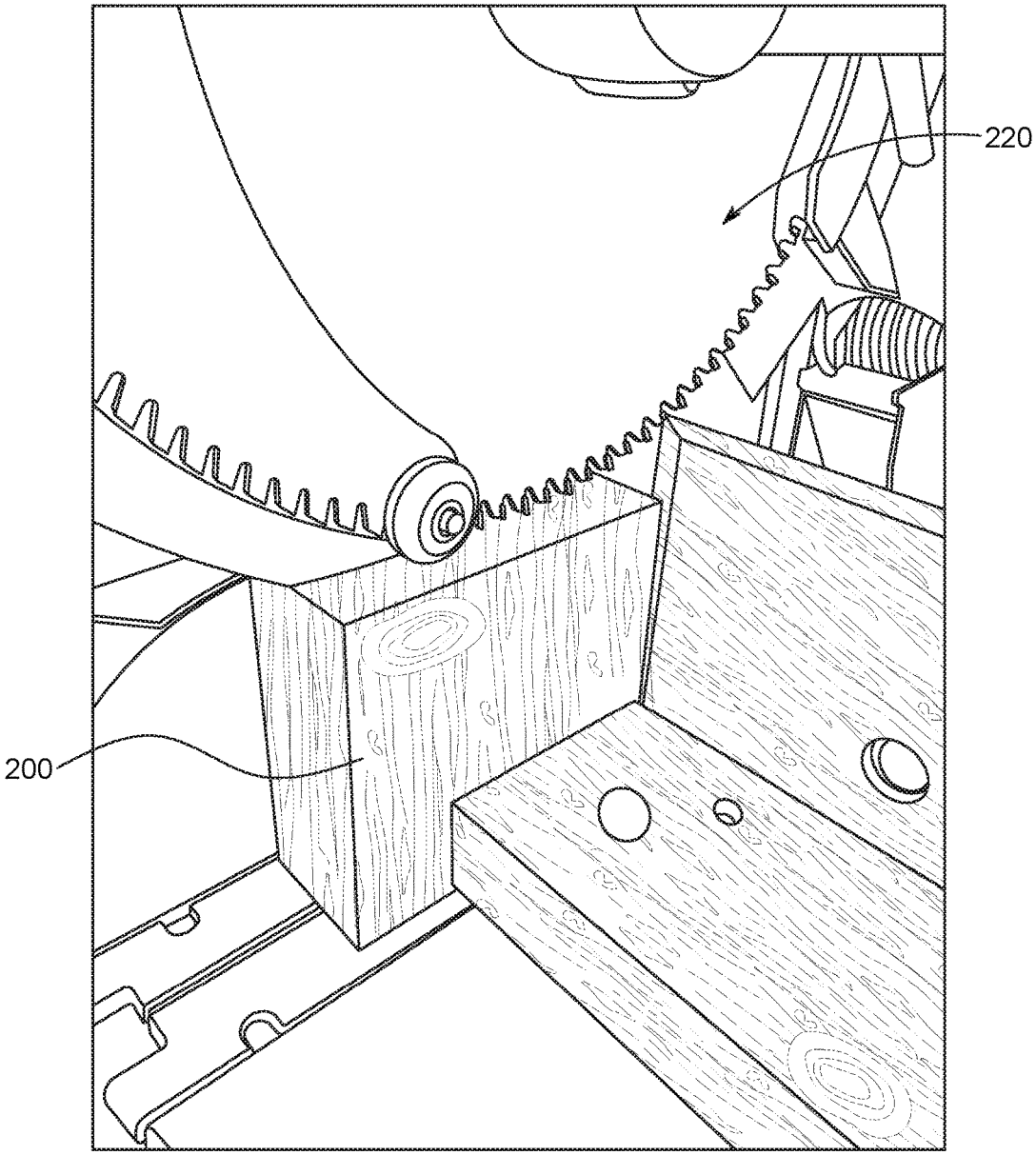
FIG. 3 illustrates a perspective view of the portion of stabilized wood that is cut along its cross-section into two flat faces, in accordance with an embodiment of the present invention.
Figure 4:
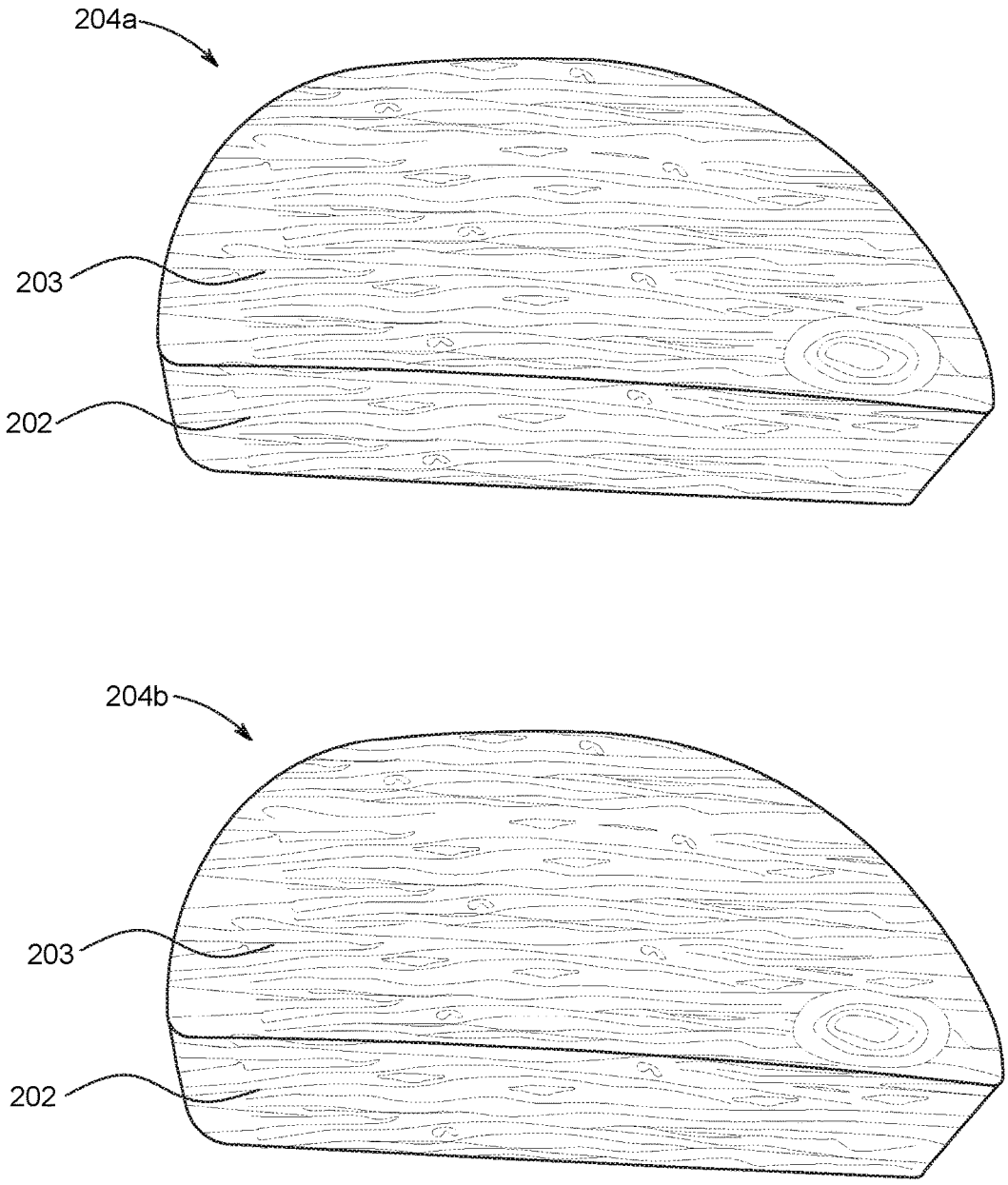
FIG. 4 illustrates a perspective view of the two flat faces of the portion of stabilized wood in accordance with an embodiment of the present invention.

In some embodiments, a Step 106 comprises cutting a cross-section of the burl wood 200 into two flat faces 204*a*, 204*b*. FIG. 3 illustrates a perspective view of a cross section of the portion of burl wood 200 cut into two sections. In one embodiment, the burl wood 200 is split in such a manner as to allow boreholes to be drilled internally so that multiple weight members can be inserted into the boreholes and epoxied in place. For this Step 106, various cutting means may be used. One means of cutting 220 the cross section involves a table saw that cuts the loft into the face, or both faces for ambidextrous putters. In other embodiments, a miter saw or belt sander could also be used to perform this task, or any other tool used to remove material from wood 200. For complex shapes, one could use a drill or band saw to complete the task. Some shapes of the cross section may result in faces 204*a*, 204*b* that are curved or parabolic, hyperbolic, or other desired contours. Such curvatures may require significant time working on a belt sander to achieve the desired shape. In yet other embodiments, a laser may be used to cut the burl wood 200. As shown in FIG. 4, the two flat faces 204*a*, 204*b* of the burl wood 200 are defined by external surfaces 202, inner surface 203 and an internal medium (not shown) having a substantially knotted composition and crossed grains.

Figure 5:
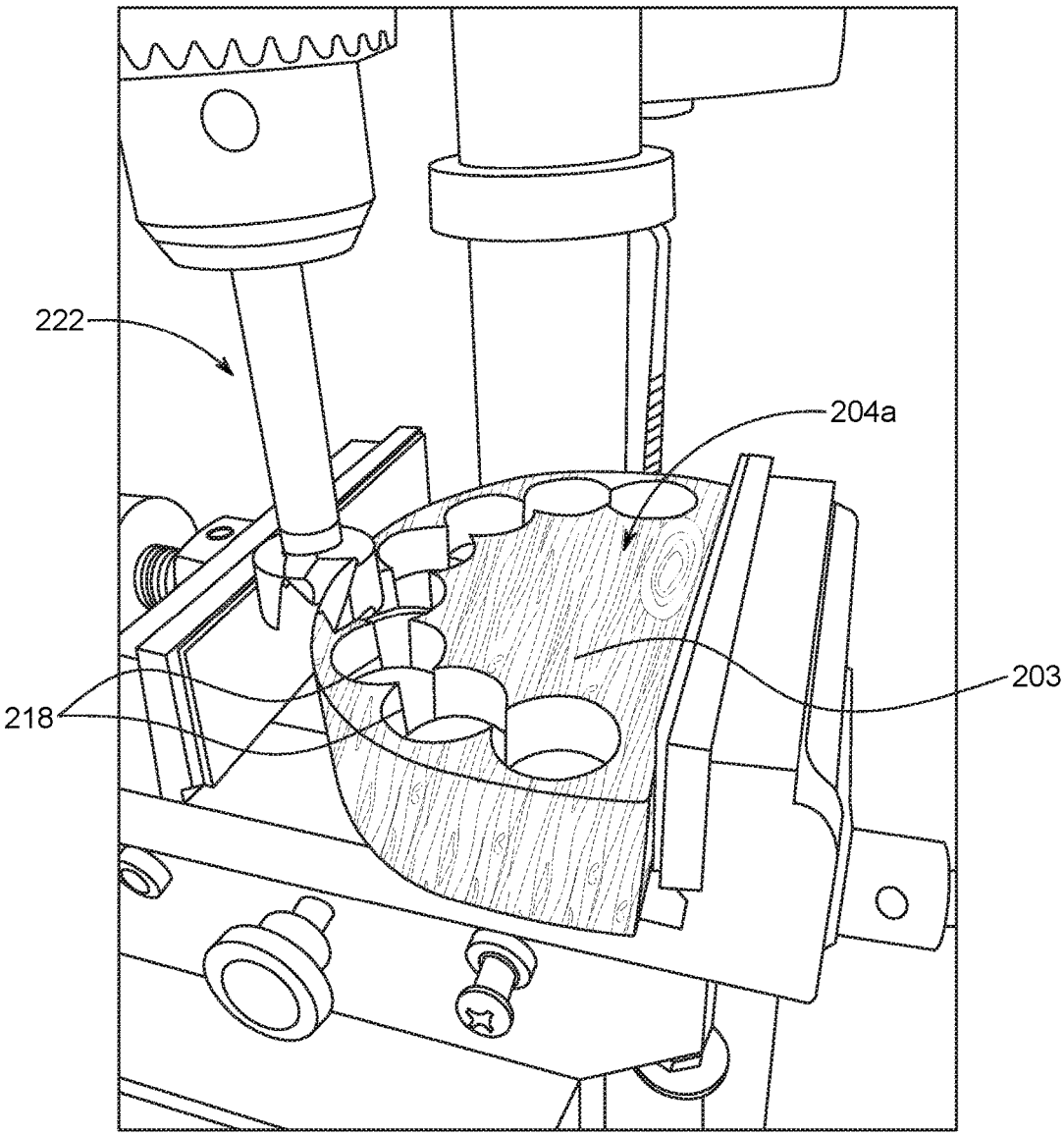
FIG. 5 illustrates a perspective view of drilling a plurality of boreholes through the internal medium of the at least one of the two flat faces of the stabilized wood, in accordance with an embodiment of the present invention.

In some embodiments, a Step 108 includes drilling a plurality of boreholes 218 through the internal medium at the inner surface 203 of the at least one of the two flat faces 204*a*, 204*b* of the burl wood as shown in FIG. 4, wherein the plurality of boreholes are drilled based on a predetermined borehole design pattern for each style of club head as shown in FIG. 5, whereby the borehole design pattern is determined using an algorithm 150. A drilling machine 222 or a hand drill or the like may be used to drill the plurality of boreholes 218 through the internal medium of the inner surface 203 of the at least one of the two flat faces 204*a*, 204*b* of the burl wood 200.

Figure 1B:
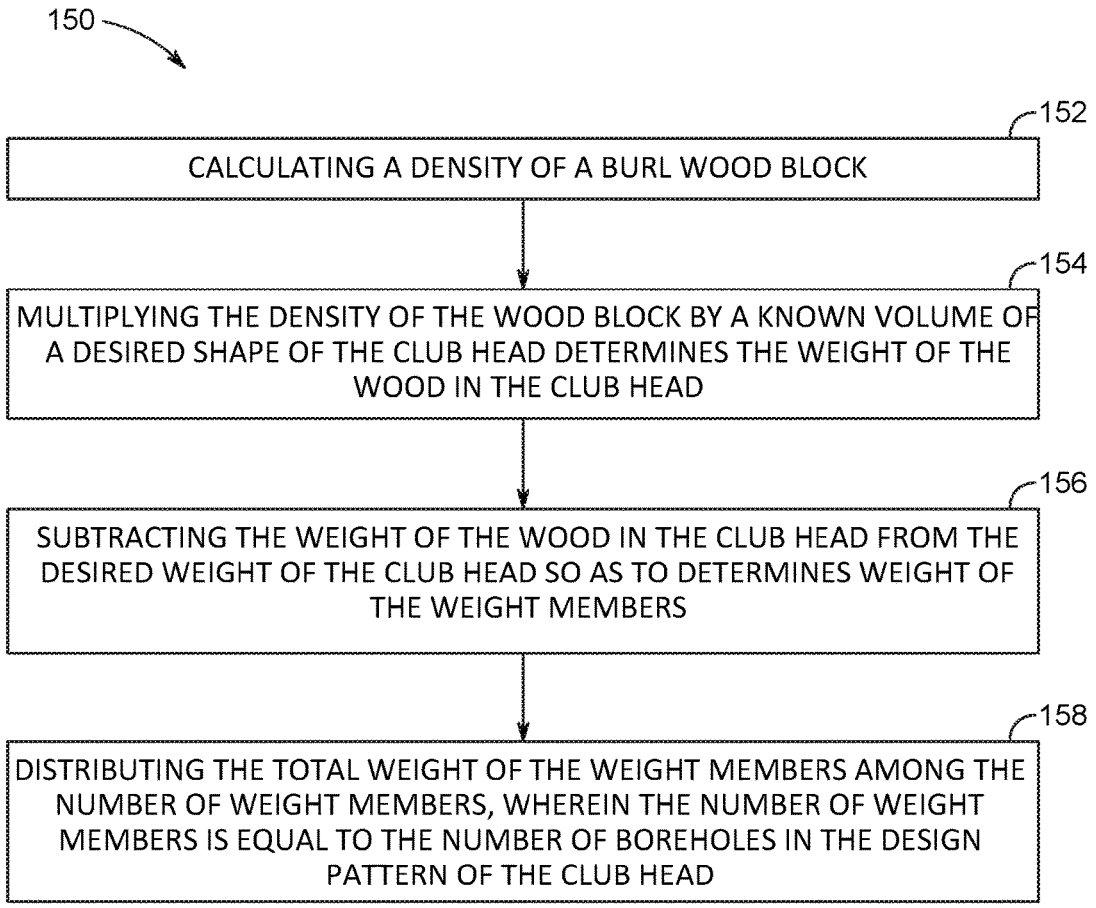
FIG. 1B illustrates a flowchart diagram of an exemplary algorithm to determine borehole design pattern of the weighted stabilized wood golf club head, in accordance with an embodiment of the present invention.

In an embodiment of the present invention the algorithm 150 is a formula or a software program to manually or automatically calculate the weight of the weight members 212, number of weight members 212 and thus the borehole design pattern 214 for a specific style of club head 210. The algorithm 150 is illustrated in FIG. 1B illustrating, the step 152 of calculating a density of the portion of burl wood 200. The density is calculated through analysis of the measurements and weight of the portion of burl wood 200, then the step 154 of multiplying the density of the wood block by a known volume of the desired shape of the club head to determine a weight of the wood in the club head; then the step 156 of subtracting the weight of the wood in the club head from the desired weight of the club head to determine the necessary weight of the weight members and then the step 158 of distributing the total weight of the weight members among the total number of weight members, wherein the number of weight members 212 is equal to the number of boreholes 218 in the design pattern 214 of the club head 210.

Figure 6:
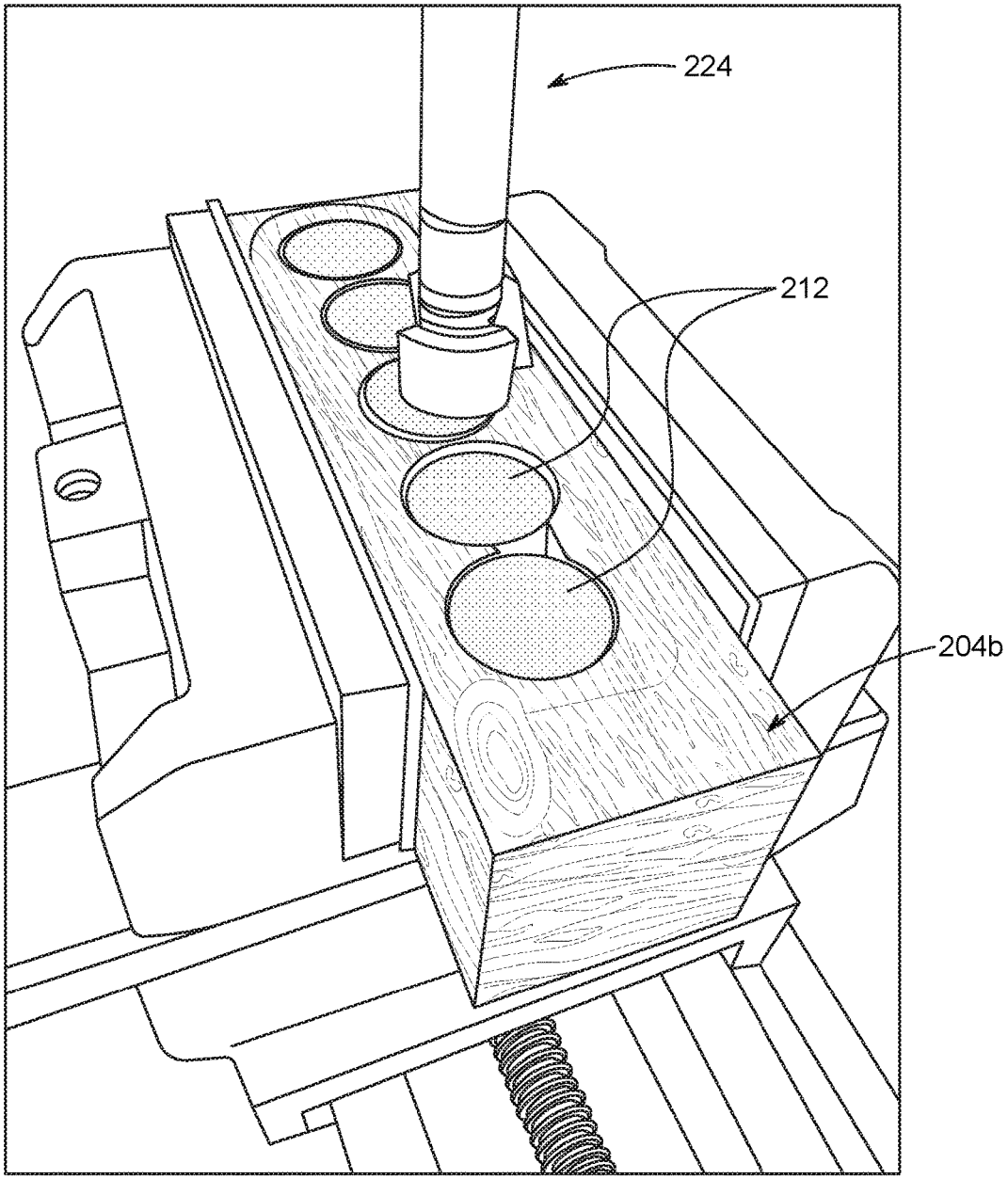
FIG. 6 illustrates a perspective view of a plurality of discrete weight members integrated into the respective plurality of boreholes, in accordance with an embodiment of the present invention.
Figure 10:
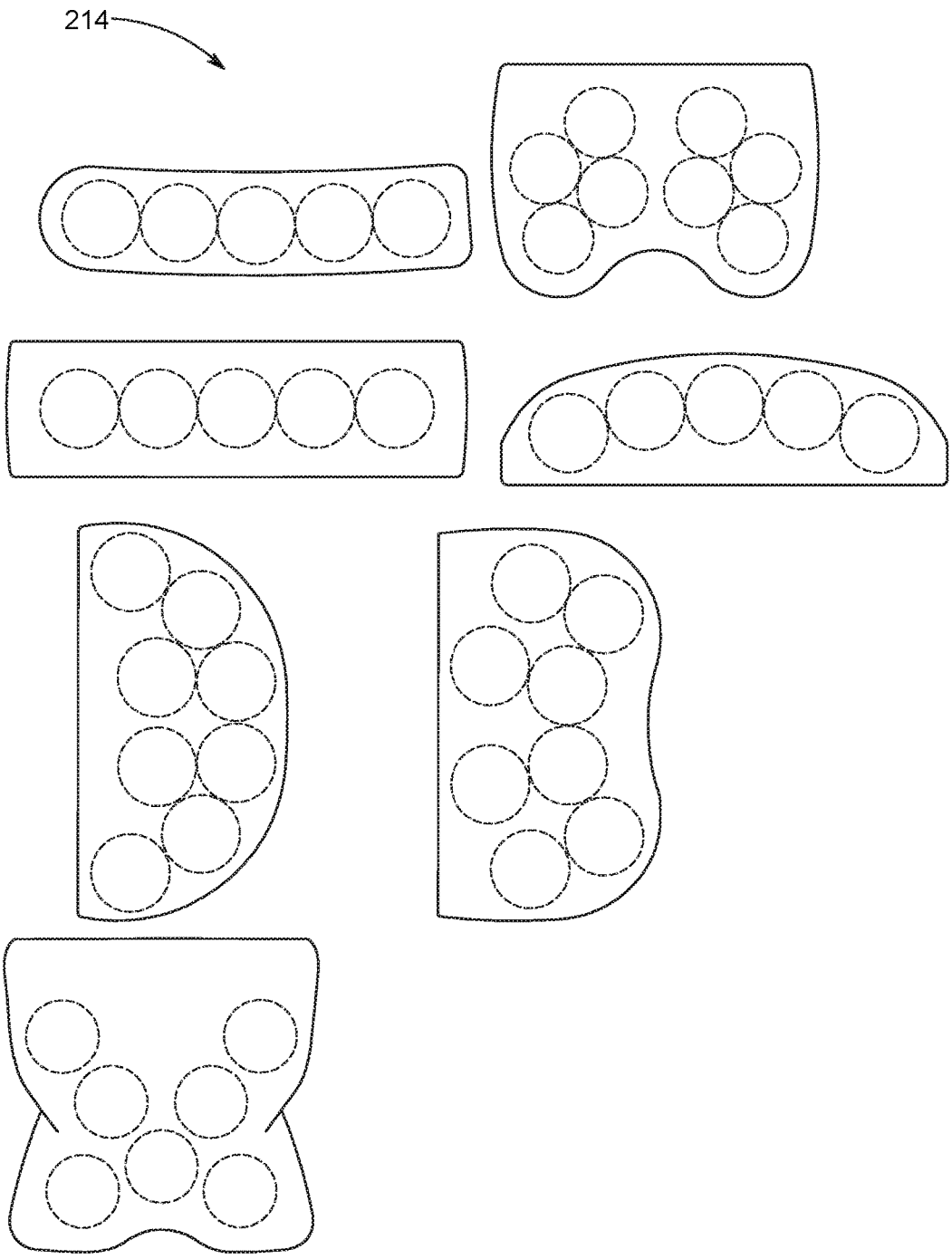
FIG. 10 illustrates a plurality of borehole design patterns for plurality types of club head, in accordance with an embodiment of the present invention.

The placement and depth of the boreholes 218 is chosen so as to control the mass, center of gravity, and moment of inertia. A Step 110 may include filling and integrating the plurality of boreholes 218 with a plurality of discrete weight members 212 as shown in FIG. 6, wherein a press machine 224 or a hammer or the like may be used to insert the weight members 212 into their respective boreholes 218 at the at least one of the flat faces 204*a*, 204*b* of the burl wood 200. Each weight member 212 may have a different weight or symmetrical weight, whereby the position and the weight of the weighted member 218 are determined by the calculated borehole pattern 214. The borehole pattern 214 based partially on the calculated density, the borehole pattern 214 configured to enable enhanced control of balance, mass, center of gravity, and moment of inertia during operation of the golf club head 210. Borehole pattern 214 of different types of club head 210 are illustrated in FIG. 10, wherein a boondock, a king, and a classic style of club head 210 have five weight members 218, while a Luna, a Checkmate, a Widowmaker, a Mid Mallet, and a new Luna XL style of club heads 210 have seven or eight or more numbers of weight members 212. Further, more weights can be placed in an eight-weight putter, as room allows. Also, we may use different-sized weights to reach the target weight of the club head 210.

In some embodiments, the plurality of discrete weight members may include metal, without limitation, lead, tungsten and golf. Then, depending on the density of the wood, different height cylinders or other shape weight members 212 are placed with different masses into each borehole 218 so as to reach the specified overall mass of the club head 210. The weight members 212 are arranged with the heaviest being in the front and the lightest being in the back of the club head 210.

Figure 7:
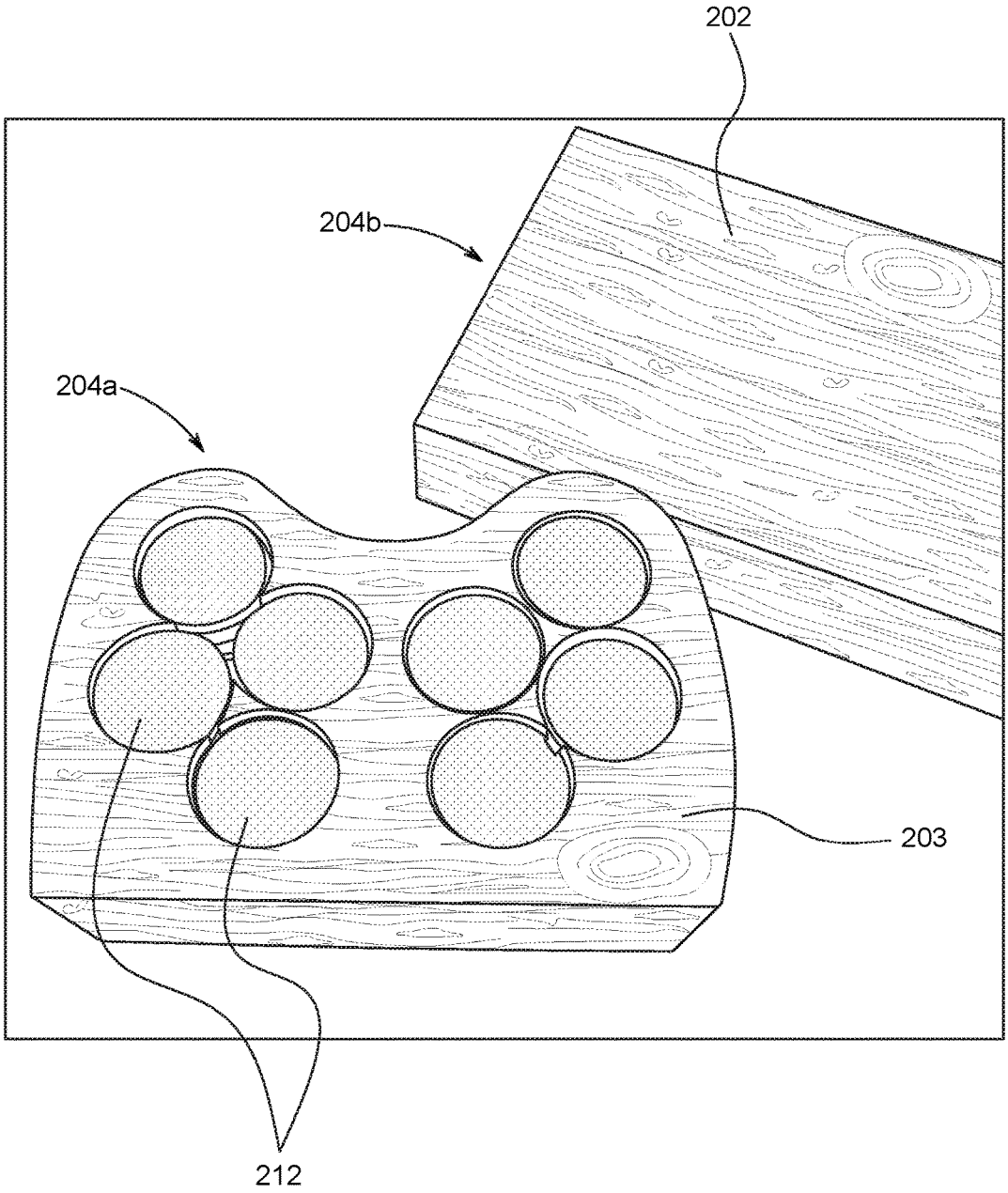
FIG. 7 illustrates a perspective view of preparing the two flat faces of the portion of stabilized wood before joining them together, in accordance with an embodiment of the present invention.
Figure 9:
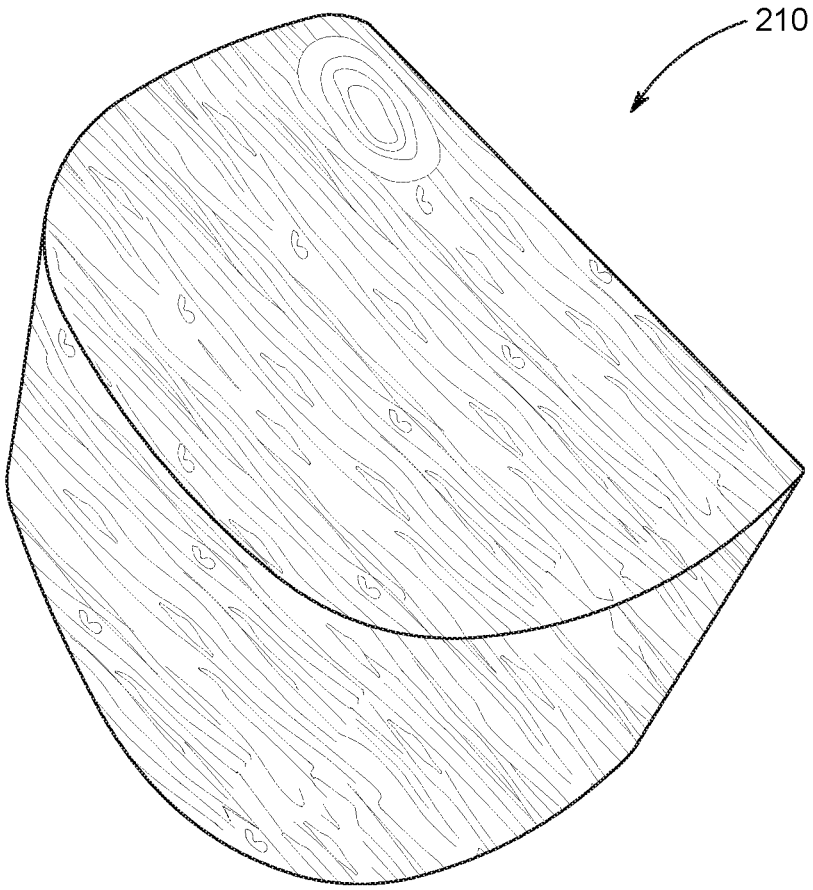
FIG. 9 illustrates a perspective view of a polished weighted stabilized wood golf club head, in accordance with an embodiment of the present invention.

FIG. 7 illustrates inserted weight members 212 according to a predetermined borehole design pattern 214 on the inner surface 203 of the flat faces 204*a*, of the burl wood 200 and applying adhesive to hold the weight members 212 securely in their respective boreholes, while the other flat face 204*b* is applied with adhesive on its inner surface and the flat faces 204*a* and 204*b* are joined in such a manner as to give the appearance that the burl wood is uncut as illustrated in FIG. 9.

Figure 8:
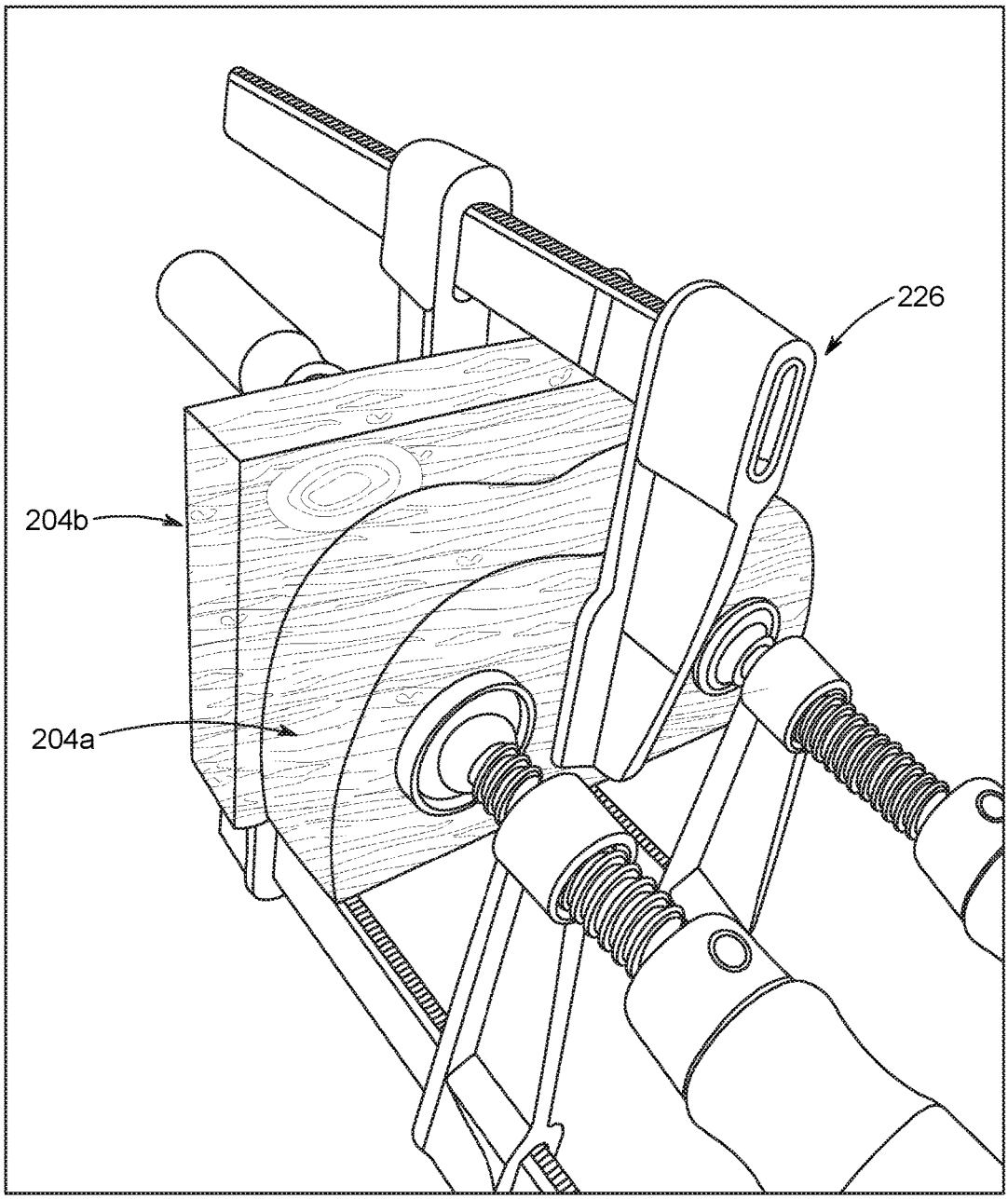
FIG. 8 illustrates a perspective view of the two flat faces joined and tightly hold by one or more clamps, in accordance with an embodiment of the present invention.

In some embodiments, Step 112 of the FIG. 1A to join the flat faces 204*a* and 204*b*, both the flat faces 204*a* and 204*b* are tightly pressed using a clamp 226 as shown in FIG. 8. Other types of clamping methods can be used, however, to properly adhere the flat faces 204*a* and 204*b* with each other to form the club head 210.

Figure 11:
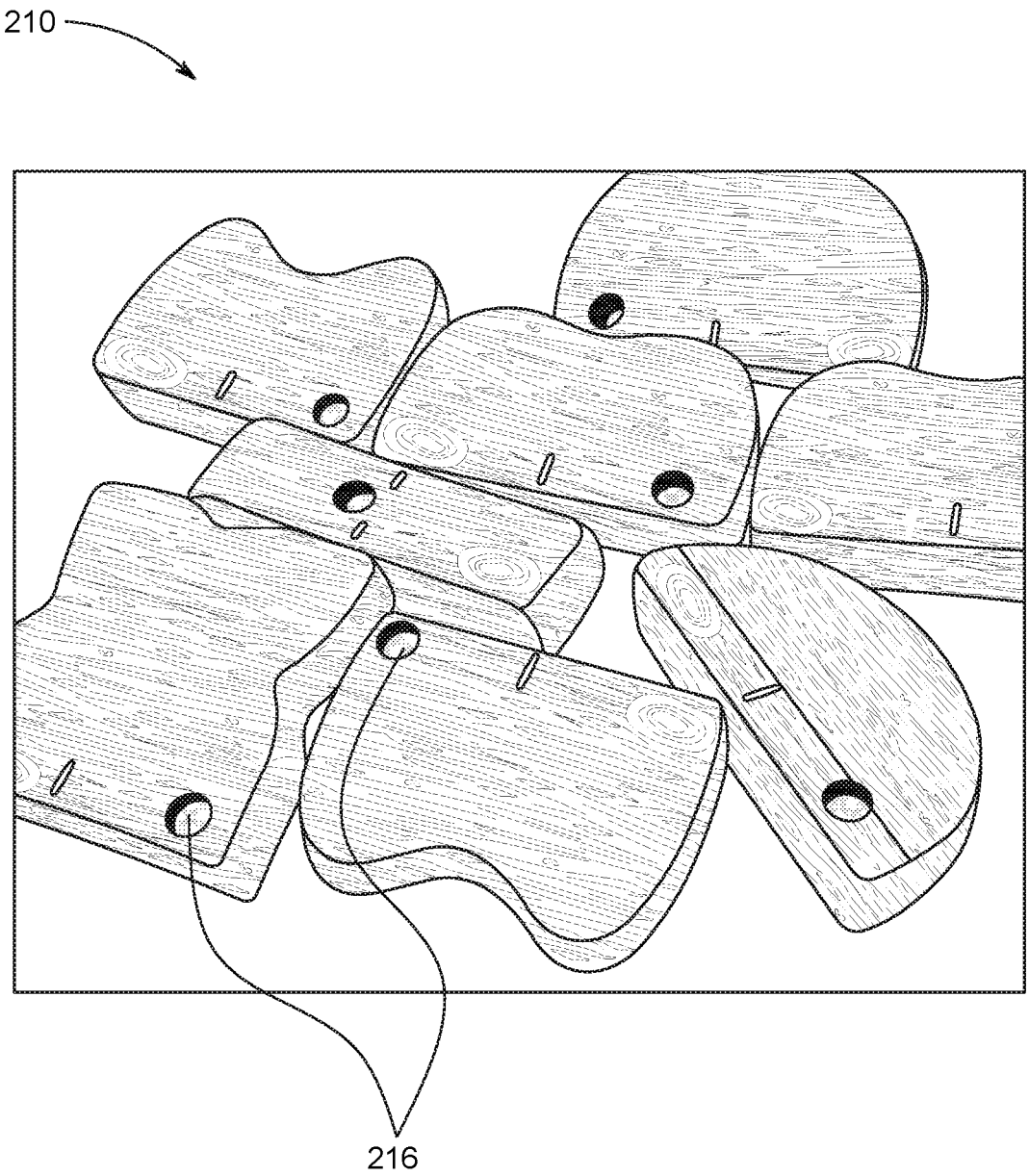
FIG. 11 illustrates a perspective view of a plurality of weighted stabilized wood golf club heads having shaft boreholes, in accordance with an embodiment of the present invention.

A step 114 comprises cutting the external surface of the burl wood to the desired style of club head 210 while simultaneously balancing the weight of the club head 210. In an exemplary embodiment, a table saw to cut the loft into the face, or both faces for ambidextrous putters 210. A miter saw or belt sander could also be used to perform this task, or any other tool used to remove material from wood. For complex shapes, one could use a drill or band saw to complete the task. Some shapes are quite curved, and may require significant time on the belt sander to achieve the desired shape of club head 210 as shown in FIG. 9 and FIG. 11.

A Step 116 of FIG. 1A comprises polishing the external surface 202 of the burl wood 200 to create a seamless appearance to the external surface 202 on the club head 210, wherein a router table or hand sander or any other similar tool is used to round the edges or polish the external surface 202 of the club head 210. This is done on most clubs, unless a sharp edge club head is desired. Any voids in the wood are filled with a two part epoxy, or other similar strength adhesive, which is then heated to allow deep penetration and a smooth, bubble free surface. The club head is then sanded with multiple grits, up to at least 1500 grit for a fine shine and to remove all epoxy from the face 202, where it is only filling the voids. The artist must appear at the face with a bright light opposite their eye so that they can view any glare from remaining epoxy on the surface. The step 116 comprises adhering the external surface 202 and the edges of the two flat faces 204*a*, 204*b* of the portion of burl wood 200, such that the joint at cut cross-sections seems substantially seamless. The seamless or substantially invisible cut section provides a finished club head 210 is shown in FIG. 9.

In one exemplary embodiment, the faces 204*a*, 204*b* that was cut off is then replaced in the exact same configuration as it was cut, with adhesive on its inside surfaces 203, and then clamped very tightly in such a manner as to give the appearance that the burl wood 200 is uncut. The faces 204*a*, 204*b* may end up offset from one another if that provides a more visually appealing appearance to align the grains. The block 200 is allowed to cure. Then the clamps 226 may be removed, and material is removed in such a manner as to be left with the desired shape for the club head 210. Afterwards, any remaining epoxy is sanded or cut away from the external surface 202.

The step 216 of polishing comprises sanding the external surface of the burl wood. The sanding process removes burrs and divots, helping to create a seamless appearance to the external surface 202 on the club head 210. In one embodiment, a router table or hand sander is used to round the edges of the club head 210. This sanding process is performed on most club heads 210, unless a sharp edge is desired. Furthermore, any voids in the burl wood 200 are filled with a two part epoxy, or other similar strength adhesive, which is then heated to allow deep penetration and a smooth, bubble free surface.

The club head 210 is then sanded with multiple grits, up to at least 1500 grit for a fine shine to remove all epoxy from the face, where it is only filling the voids. The fabricator or artist must appear at the face of the golf club head with a bright light opposite their eyes so that they can detect any glare from remaining epoxy on the surface. Once the club head has all the proper indicia 206, logos, and markings, it receives one more sanding at a very high grit, 1500 or more, and is then buffed using a buffing machine and any common wood buffing compound.

A Step 118 includes attaching a shaft to the portion of burl wood, wherein the shaft comprises a distal end and a proximal end, the proximal end of the shaft engages the burl wood and a grip is attached to the distal end of the shaft. This step 118 may include a further step of drilling a shaft borehole in the proper location of the burl wood 200, based off the original drawing, to the specified depth such as to allow a strong bond between burl wood 200 and shaft 208.

In one embodiment, the drilled shaft borehole 216 is defined by an angle of at least 10°, with respect to the vertical axis of the club head 210 so as to provide optimal performance and comply with golfing standards. Those skilled in the art will recognize that the shaft borehole 216 may be at an angle greater than 10° to account for USGA rules for a straight shaft 208, or it may be a vertical hole to allow for a shaft 208 with a proper bend in it.

The shaft 208, which may be any possible type of golf shaft, is then inserted into the shaft borehole 216 and a tape is wrapped around the exposed one inch or more from the proximal end 229, or top of the shaft borehole. This is to protect the shaft 208. The part that is inside the club head 210 is, however, roughed using low grit sandpaper to increase adhesion. Grooves of $1/16^{th}$ inch are cut one quarter inch deep into the end of the shaft 208 to allow for epoxy to fill the space and prevent the shaft 208 from twisting free. The shaft 208 is then adhered within the shaft borehole 216 and aligned to match the proper specifications. The shaft joint is then allowed to cure and the tape is then removed. The shaft 208 is cut to the desired length, and a grip 228 is mounted using standard grip installation procedures. A Step 124 includes attaching a grip 228 to the distal end 227 of the shaft 208.

In one exemplary embodiment, the method 100 of the present invention as shown in FIG. 1A, an additional step includes applying a composition and indicia 206 on the external surface 202. At this point in the method 100, a logo or any other text or pictures is either burnt on using a branding tool or wood burning tool, or laser cut into the surface.

It is significant to note that for burl wood 200 that is cut by a laser, tape is placed over the wood prior to the cut. This protects from smoke affecting the peripheral material, and prepares the surface for eventual paint fill. If the logo or text is integrated into the burl wood 200 with a laser, the recessed cut may then be filled with paint or epoxy or any other type of adhesive that would highlight the logo or text.

It is also significant to note that care should be taken to ensure that the material does not rise above the top of the surface, while also not being deeply recessed below the top of the surface. The paint fill is placed while the remaining tape from the laser cut is allowed to remain on the top external surface 202 of the burl wood 200. The tape is then removed as the paint fill is drying.

In alternative embodiments, the method 100 may include a further step of testing the completed golf club head for satisfactory balance and golf ball hitting capacity; whereby adjustments to the balance of the burl wood 200, as used as a golf club head, are made by selectively cutting sections from the burl wood 200, so as to achieve desired angles on the external surface 202.

The club head or the putter 210 may then be swung to ensure proper feel and a sufficient sweet spot. If the golf club does not feel right, modifications are made to the overall shape to modify the lie angle until it rolls properly. Those skilled in the art will recognize that the swing weight of a golf club 230, it is conventional practice to horizontally position the club 230 on a swing weight scale having a fulcrum positioned intermediate the ends of the club 230 such that the head end is left unsupported. The swing weight is then determined from the upwardly directed force at the grip end of the club resulting from the moment of the club head portion of the club about the fulcrum.

Another embodiment includes painting the boreholes 218 with a clear acrylic that makes the weight members 212 visible.

Another embodiment includes painting the weight members 212 with a clear acrylic that makes the weight members 212 visible.

Preferably, the weights should be symmetric about the center of the club head 210 as much as possible. It is the symmetry of the multiple weight members 212 that causes the low frequency vibrations to enhance its smooth use.

For live edge putters, determining the volume of the burl wood block/portion is difficult, thus the putter or the club head is shaped prior to drilling holes. The shaped club head is weighed to determine the weight "W1" of the club head. A hole is drilled to a standard depth, and weighed to identify weight "W2" of one hole. For example, if the live edge putter will have "n" holes, then the total weight "Wn" of "n" holes is calculated. Subtracting the total weight "Wn" of "n" holes from the weight "W1" of the club head to determine weight "W3" of the drilled club head. Then subtracting the weight "W3" from a desired final weight "W4" of the putter/club head determines desired total weight of weight members. Then inserting the weight members into the plurality of drilled holes and sealed by applying a coating of epoxy or adhesive to achieve the weighted live edge club head.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A method for fabricating weighted stabilized wood golf club heads, the method comprising:

selecting a portion of stabilized wood based on its desired color, variation, hardness, shape, and density, wherein the stabilized wood is defined by an external surface and an internal medium having a substantially knotted composition and crossed grains;

choosing optimal sides based on the knotted composition and the crossed grains to be the face and top of the club head;

cutting the stabilized wood along its cross-section into two flat faces;

drilling a plurality of boreholes through the internal medium of the at least one of the two flat faces of the stabilized wood, wherein the plurality of boreholes are drilled based on a predetermined borehole design pattern for each style of club head, whereby the borehole design pattern is determined using an algorithm;

integrating the plurality of boreholes with a plurality of discrete weight members, so as to customize the location of a center of gravity, the swing weight, total weight, moment of inertia and enhance balance of a golf club;

joining the two flat faces in such a manner as to give an appearance that the stabilized wood is uncut;

cutting the external surface of the stabilized wood to a desired style of club head while simultaneously balancing the weight of the club head;

polishing the external surface of the stabilized wood to create a seamless appearance to the external surface on the club head; and attaching a shaft to the portion of stabilized wood, wherein the shaft comprises a distal end and a proximal end, the proximal end of the shaft engages the stabilized wood and a grip is attached to the distal end of the shaft.

2. The method of claim 1, wherein the portion of the stabilized wood is cut square on all sides before cutting the stabilized wood along its cross-section into the two flat faces.

3. The method of claim 1, wherein the two flat faces are joined by applying adhesive to inside surfaces of the two flat faces and tightly holding together the two flat faces of the stabilized wood by one or more clamps, thereby curing a joint between the two flat faces.

4. The method of claim 1, wherein the algorithm comprises:

calculating a density of the stabilized wood;

multiplying the density of the wood block by a known volume of a desired shape of the club head to determine the weight of the wood in the club head;

subtracting the weight of the wood in the club head from the desired weight of the club head determines a necessary weight of the weight members; and distributing the total weight of the weight members among the number of weight members, wherein the number of weight members is equal to the number of boreholes in the design pattern of the club head.

5. The method of claim 1, wherein the polishing comprises sanding the external surface of the stabilized wood in such a manner as to give an appearance that the stabilized wood is uncut.

6. The method of claim 1, wherein the stabilized wood is burl wood.

7. The method of claim 1, further comprising a step of drilling a shaft borehole in the portion of the stabilized wood.

8. The method of claim 1, wherein the drilled shaft bore is defined by an angle of at least 10 degrees with respect to the vertical axis of the club head.

9. The method of claim 1, further comprising a step of selectively cutting sections from the stabilized wood, so as to balance weight of the club head and achieve desired angles on the external surfaces of the club head.

10. The method of claim 1, wherein the step of integrating the weight members into the boreholes comprises integrating the heaviest weight member into the front of the golf club head and integrating the lightest weight member into in the back of the golf club head.

11. A method for fabricating weighted stabilized wood golf club heads, the method comprising:

selecting a portion of stabilized wood based on its desired color, variation, hardness, shape, and density, wherein the stabilized wood is defined by an external surface and an internal medium having a substantially knotted composition and crossed grains;

choosing optimal sides based on individual characteristics to be a face and top of the club head, wherein the portion of the stabilized wood is cut square on all sides;

cutting the stabilized wood along its cross-section into two flat faces;

drilling a plurality of boreholes through the internal medium of the at least one of the two flat faces of the stabilized wood, wherein the plurality of boreholes are drilled based on a predetermined borehole design pattern, whereby the borehole design pattern, number of weight members and the weight of each of the weight members is determined using an algorithm, thereby allowing integration of the weight members into the boreholes, so as to customize the location of a center of gravity, swing weight, total weight, moment of inertia and balance of a golf club, wherein the algorithm comprises:

calculating a density of the stabilized wood, multiplying the density of the wood block by a known volume of a desired shape of the club head to determine the weight of the wood in the club head, subtracting the weight of the wood in the club head from the desired weight of the club head determines the necessary weight of the weight members, and distributing the total weight of the weight members among the number of weight members, wherein the number of weight members is equal to the number of boreholes in the design pattern of the club head;

integrating each of the weight members into the respective boreholes, wherein the heaviest weight member is integrated into the front of the golf club head and the lightest weight member is integrated into the back of the golf club head;

joining the two flat faces by applying adhesive to inside surfaces of the two flat faces and tightly holding together the two flat faces of the stabilized wood, thereby creating a joint, so as to cure the joint and provide an appearance that the stabilized wood is uncut;

cutting the external surface of the stabilized wood to the desired style of club head and polishing it to create a seamless appearance of the external surface on the club head;

drilling a shaft borehole in the portion of stabilized wood; and attaching a shaft to the shaft borehole, wherein the shaft comprises a distal end and a proximal end, the proximal end of the shaft engages the stabilized wood and a grip is attached to the distal end of the shaft.

12. The method of claim 11, wherein the plurality of discrete weight members comprise a metal selected from the group consisting of lead, tungsten and gold.

13. The method of claim 11, wherein the stabilized wood is burl wood.

14. The method of claim 11, wherein the drilled shaft bore is defined by an angle of at least 10 degrees with respect to the vertical axis of the club head.

15. The method of claim 11, further comprising a step of selectively cutting sections from the stabilized wood, so as to balance weight of the club head and achieve desired angles on the external surfaces of the club head.

16. A weighted stabilized wood golf club head comprising:

two flat faces of the club head, wherein the flat faces are defined by external surfaces, inner surface and an internal medium having a substantially knotted composition and crossed grains;

a plurality of boreholes at the inner surface through the internal medium of at least one of the two faces of the stabilized wood following a predetermined borehole design pattern for each style of the club head;

a plurality of discrete weight members inserted into the respective plurality of boreholes, wherein the heaviest weight member being in the front and the lightest weight member being arranged in the back of the borehole design pattern, whereby the borehole design pattern, total number of weight members and the weight of each of the weight members is determined using an algorithm, thereby allowing integration of the weight members into the boreholes, so as to customize the location of the center of gravity, the swing weight, the total weight, moment of inertia and enhance the balance of a golf club, wherein the algorithm comprises calculating a density of the stabilized wood block, multiplying the density of the wood block by a known volume of a desired shape of the club head determines the weight of the wood in the club head, subtracting the weight of the wood in the club head from the desired weight of the club head so as to determines weight of the weight members, and distributing the total weight of the weight members among the number of weight members, wherein the number of weight members is equal to the number of boreholes in the design pattern of the club head; and a shaft comprising a distal end and a proximal end, wherein the proximal end of the shaft is attached to a shaft borehole on the external surface of the stabilized wood and a grip is attached to the distal end of the shaft.

17. The weighted stabilized wood golf club head of claim 16, wherein the plurality of discrete weight members comprise a metal selected from the group consisting of lead, tungsten and gold.

18. The weighted stabilized wood golf club head of claim 16, wherein the two flat faces are joined by applying adhesive to inside surfaces of the two flat faces and tightly holding together the two flat faces of the stabilized wood, thereby creating a joint, so as to cure the joint and provide an appearance that the stabilized wood is uncut.

19. The weighted stabilized wood golf club head of claim 16, wherein the drilled shaft bore is defined by an angle of at least 10 degrees with respect to the vertical axis of the club head.

* * * * *